US005391184A

United States Patent [19]

Rosenthal

[11] Patent Number: 5,391,184

[45] Date of Patent: Feb. 21, 1995

[54] PACIFIER SYSTEM FOR INFANTS

[76] Inventor: Mary E. Rosenthal, 3625 N. Country Club Dr., El Dorado Three, Apartment 1901, North Miami Beach, Fla. 33180

[21] Appl. No.: 15,198

[22] Filed: Feb. 11, 1993

[51] Int. Cl.[6] ..... A61J 17/00

[52] U.S. Cl. ..... 606/236; 606/234

[58] Field of Search ..... 606/234–236; D24/194–199

[56] References Cited

U.S. PATENT DOCUMENTS

| | | | |
|---|---|---|---|
| 2,811,949 | 11/1957 | Rothbard | 606/236 |
| 3,283,758 | 11/1966 | Killebrew | 606/234 |
| 5,147,384 | 9/1992 | La Rocca | 606/236 |
| 5,156,617 | 10/1992 | Reid | 606/236 |

FOREIGN PATENT DOCUMENTS

| | | | |
|---|---|---|---|
| 2837438 | 3/1980 | Germany | 606/235 |

*Primary Examiner*—Stephen C. Pellegrino
*Assistant Examiner*—Glenn Dawson
*Attorney, Agent, or Firm*—M. K. Silverman

[57] ABSTRACT

A pacification system for use by an infant constitutes a bracelet including, on at least one tangential surface, a planer surface including a first fabric engagement element. The system also includes a pacifier which includes, on a planer base thereof, a second fabric engagement element, complemental in surface characteristic to the first fabric engagement element. The first and second engagement elements are detachably attachable through the respective application by the infant of pulling and pressing forces. The instant system may be employed either with or without the bracelet portion.

2 Claims, 3 Drawing Sheets

PACIFIER SYSTEM FOR INFANTS

BACKGROUND OF THE INVENTION

The present invention relates to an improvement in a pacifier which addresses the problem of loss or misplacement of such pacifiers by infants. A longstanding problem in the use of pacifiers has been the propensity of children to lose or misplace them. This problem has been considered in certain prior art and, more particularly, in U.S. Pat. No. 2,798,482 (1957) to Feehey, entitled Hand-Attached Accessory Device For Infants.

Feehey teaches a pacifier in combination with a gripping means which encircles the hand of the infant. While, in Feeney, it is possible to remove the nipple portion thereof from the rest of the system, such removal cannot be accomplished by the infant. Therefore the nipple element of Fenney is not adapted for selectable independent use by the infant, as is the case in the within invention.

SUMMARY OF THE INVENTION

The instant invention relates to a pacification system for use by an infant. The system comprises a bracelet including, on at least one tangential surface thereof, a planer surface including first fabric engagement means. The inventive system also includes a pacifier which includes, at a planer base thereof, second fabric engagement means, complemental in surface properties to said first fabric engagement means, said first and second engagement means being detachably attachable through the respective application by the infant of pulling and pressing forces, Thereby the instant system may be employed either with or without the bracelet portion thereof and, when employed without the bracelet portion, will provide to the pacifier portion a fixed identifiable location therefor.

It is, accordingly, an object of the present invention to provide a pacifier system which will minimize the possibility of loss or misplacement of a pacifier and, thereby, frustration to the infant particularly at night in his crib.

It is another object of the present invention to provide a pacifier system by which an infant may utilize, in a coordinated fashion, movements of his forearm to lift the pacifier component of the system into his mouth.

It is a further object of the present invention to provide a pacification system that may be used either with or without the bracelet component thereof.

It is a yet further object of the present invention to provide a pacifier system having particular utility when an infant is in a vehicle such as an automobile.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
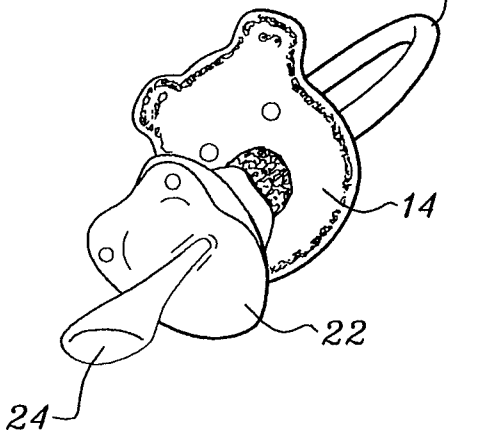
FIG. 1 is a perspective view of the inventive pacifier system.

With reference to the views of FIGS. 1 thru 6, the inventive infant pacification system may be seen to include a bracelet element 10 and a pacifier element 12. The bracelet element includes, more particularly, a flat planar surface 14 including, at the center thereof, VELCRO or fabric engagement means 16. As may be noted in the view of FIGS. 1 and 5, surface 14 will typically exhibit the form of a fanciful subject appealing to a child. As may be noted in FIGS. 1 and 5, the surface 14 therein is provided with the appearance of the face of a teddy bear. Integrally attached to the back surface of said surface 14 is a fabric-formed bracelet 18 which, in the manner shown in FIGS. 7 thru 10, will extensibly engage the wrist portion of an infant 20. Bracelet 18 may be formed of a variety of materials but, preferably, will be formed of a soft elastic fabric.

In regard to the views of FIGS. 1 thru 4, the pacifier element 12 of the instant invention may be seen to, particularly, include a rounded planar base 22 and a nipple 24 which extends integrally from said base 22, such that said elements 22 and 24, in combination, comprise the entire pacifier element 12.

Figure 3:
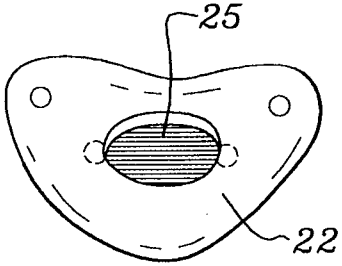
FIG. 3 is a back view of a base of a pacifier element of the system.
Figure 5:
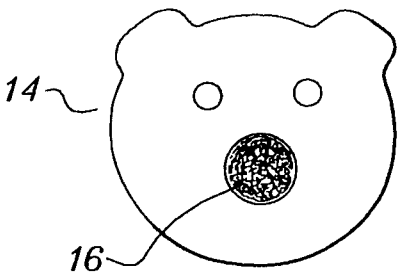
FIG. 5 is a front view of a planar surface of a bracelet element of the system.
Figure 2:
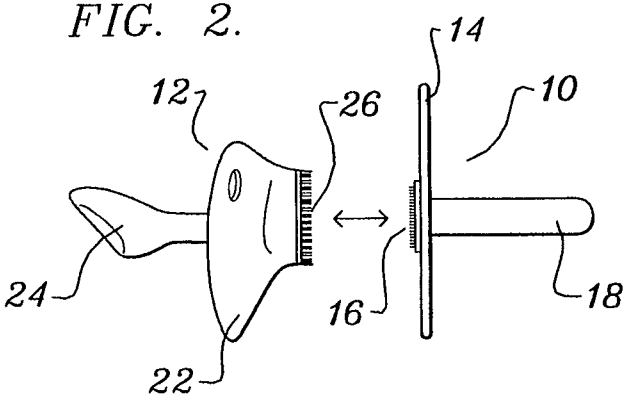
FIG. 2 is an exploded view of the system of FIG. 1 showing the components thereof.
Figure 4:
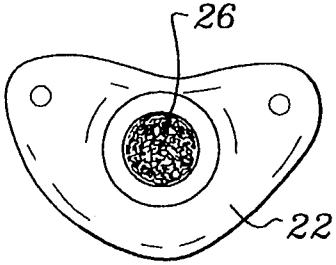
FIG. 4 is a view, similar to FIG. 3, however showing VELCRO means on the planar surface.
Figure 6:
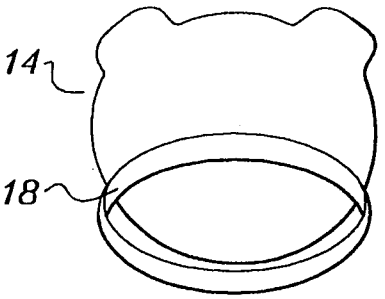
FIG. 6 is a back view of the bracelet element of FIG. 5.
Figure 8:
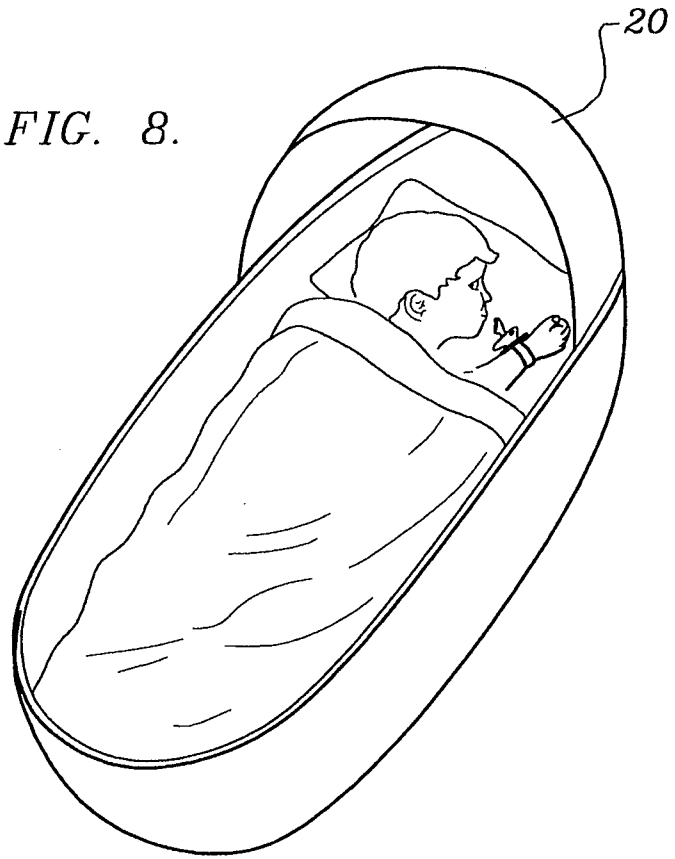
FIG. 8 is a view, similar to the view of FIG. 7, showing alternative form of use by the infant.
Figure 7:
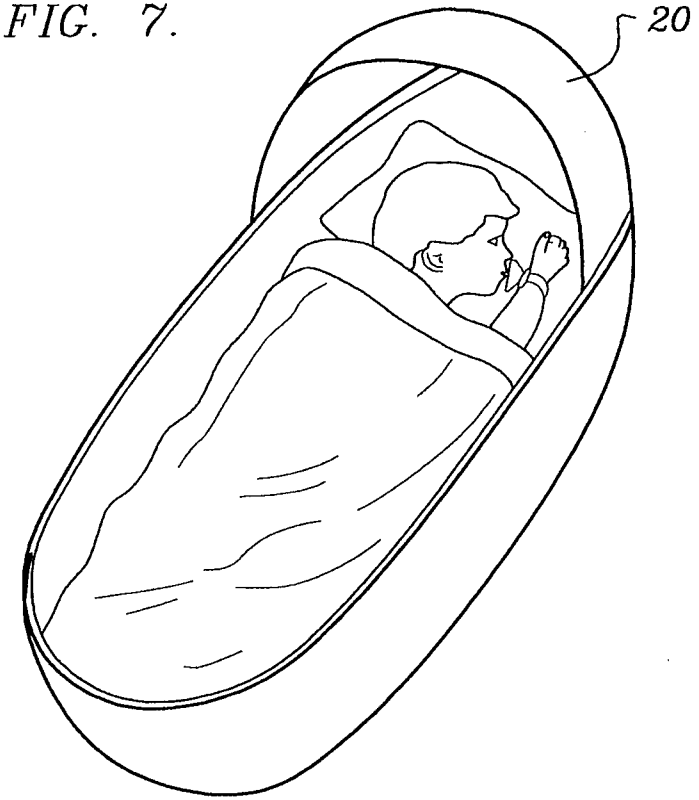
FIG. 7 is an operational view showing use of the system by an infant.
Figure 10:
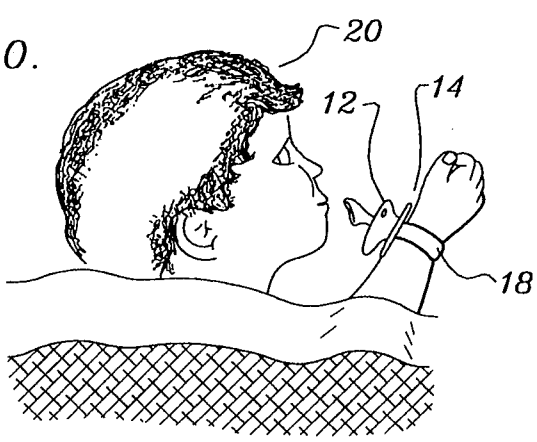
FIG. 10 is an enlarged view of a portion of FIG. 8.
Figure 9:
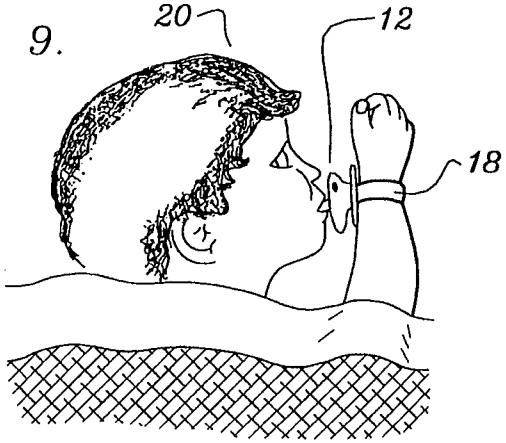
FIG. 9 is an enlarged view of a portion of FIG. 7.

As may be seen in the views of FIGS. 3 and 4, planar base 22 (non-nipple side) of pacifier element 12 is initially produced with a central recess 25 in which is inserted VELCRO or fabric engagement means 26. Fabric engagement means 26 is complemental in surface properties to VELCRO means 16 of planar surface 14 of bracelet element 10, above described.

The effect of the above described combination of elements is to effect a pacifier system which may be used either with or without bracelet element 10. In other words, as is shown in FIGS. 7 thru 10, the inventive system may be utilized by the infant 20 with fabric portions 16 of bracelet elements 10 secured to VELCRO means 26 of pacifier element 12, or separated therefrom. The practical significance of such a bi-modal pacifier system is that an infant wishing to employ the nipple 24 of the pacifier element 12, as a conventional pacifier, may do so but, alternatively, where the infant wishes to employ the pacifier element 12 in the manner shown in FIGS. 7 and 9, he may readily do so such that, after use of the pacifier, it will remain attached to the bracelet element 10 of the system such that it will remain available for continual use.

It has been determined that an infant can readily adjust to using the instant pacifier system in substantially the same manner as a conventional pacifier is employed and with an equal level of satisfaction. In other words, it has been discovered that most infants are willing and able to move their forearm toward their mouth to make contact and with and use a pacifier just as if they were moving their forearm to suck on their thumb. Therefore, in the use of the inventive pacification system, the infant will always know how to access his pacifier because it is effectively attached to the bracelet element 10 of the invention.

It is to be appreciated that the VELCRO connection between said fabric engagement means 16 and 26 also affords a safety feature in that should the infant provide sufficient stress to the interface between fabric engagement means 16 and 26, the pacifier element 12 of the invention will simply separate from the bracelet element thereby obviating any possibility of injury to the infant. Also, the infant will soon learn that he can use his other hand to separate the pacifier element from the bracelet element so that, as the infant grows older, he is able to make his own decision as to whether or not to employ the inventive pacifier system in the manner shown in FIGS. 7 thru 10 or in the fashion of an otherwise conventional pacifier. Even where the latter occurs, the infant's mother will readily be able to re-attach the pacifier element to the bracelet element so that the infant can re-use the same in whatever fashion he may wish.

Figure 11:
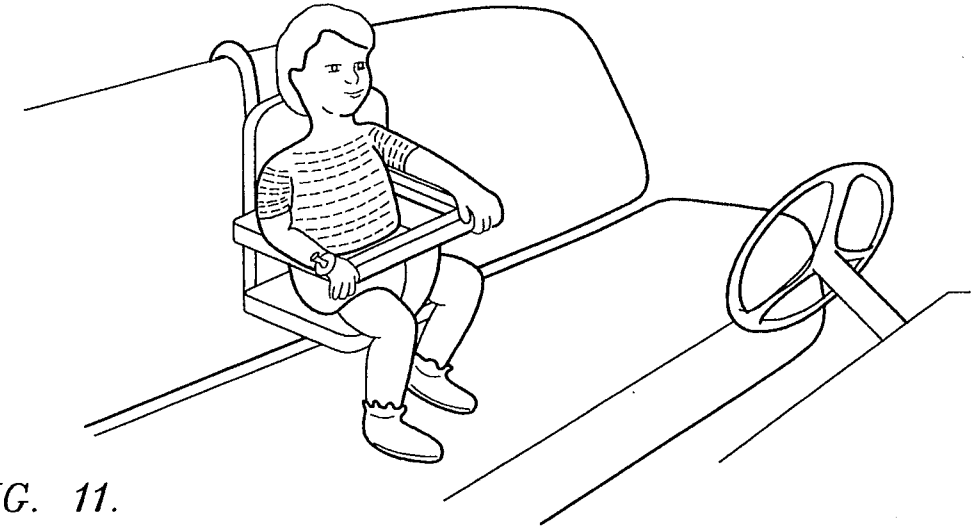
FIG. 11 is a perspective view showing use of the pacifier system by a small child in a child's automobile car seat.

In FIG. 11 is shown usage of the pacifier system outside of the household. Therein a small child is shown secured within an automobile car seat. As is well known, it is common for infants to lose pacifiers when they are transported by their parents. As such, the instant system enjoys particular utility in such environments where, clearly, an infant's loss of a pacifier will be much more difficult with the use of the present system. Therefore, one cause of driver distraction, when an infant is in the car, is eliminated.

Accordingly, while there has been shown and described the preferred embodiment of the present invention it is to be appreciated that the invention may be embodied otherwise than is herein specifically shown and described and that within such embodiment certain changes may be made in the form and arrangement of the parts without departing form the underlying idea or principle of this invention within the scope of the Claims appended herewith,

Having thus described my invention what I claim as new, useful and non-obvious and, accordingly, secure by Letters Patent of the United States is:

1. An infant pacifier system, comprising:

(a) a bracelet element comprising an expansible fabric-formed bracelet and, secured to an outer tangential surface thereof, a planar surface having, on a non-secured side of said planar surface, first fabric engagement means; and (b) a pacifier element including a planar base thereof and integrally dependent therefrom a nipple, said base on a surface opposite said nipple having second fabric engagement means, complemental in surface property to said first fabric engagement means, said first and second engagement means detachably attachable through the respective application of pulling and pressing forces upon an interface therebetween, whereby said pacifier element of said system may be employed either with or without said bracelet element thereof.

2. The system as recited in claim 1 in which said planar surface of said bracelet element is provided, on the same side as said first fabric engagement means, with a fanciful design of a type appealing to an infant.

* * * * *